United States Patent [19]

Farris

[11] 4,211,187

[45] Jul. 8, 1980

[54] ENERGY CONSERVATION SYSTEM FOR HOT WATER HEATERS AND STORAGE TANKS

[76] Inventor: William C. Farris, 3109 Debera Way, Louisville, Ky. 40220

[21] Appl. No.: 894,801

[22] Filed: Apr. 10, 1978

[51] Int. Cl.[2] ..... F22B 33/00

[52] U.S. Cl. ..... 122/20 B; 122/421; 126/365; 237/8 R; 237/19

[58] Field of Search ..... 122/20 B, 412, 421; 237/1 A, 8 R, 19; 126/365, 292, 294

[56] References Cited

U.S. PATENT DOCUMENTS

| | | | |
|---|---|---|---|
| 1,402,214 | 1/1922 | Connelly | 126/294 |
| 1,641,875 | 9/1927 | Beaulieu | 126/292 |
| 1,694,191 | 12/1928 | Sommer | 122/20 |
| 2,072,758 | 3/1937 | Libby | 126/312 |
| 2,166,355 | 7/1939 | Higgins et al. | 126/365 |
| 2,521,462 | 9/1950 | Kinzelmann | 122/20 |
| 2,985,149 | 5/1961 | Mauro et al. | 122/20 |
| 3,896,992 | 7/1975 | Borovina et al. | 122/20 |
| 3,999,709 | 12/1976 | Estabrook | 237/19 |
| 4,037,567 | 7/1977 | Torres | 122/421 |
| 4,037,786 | 7/1977 | Munroe | 237/19 |
| 4,120,267 | 10/1978 | Wood | 122/421 |
| 4,122,801 | 10/1978 | Barns | 122/20 |
| 4,126,270 | 11/1978 | Hummel | 237/1 |

*Primary Examiner*—Edward G. Favors
*Attorney, Agent, or Firm*—Maurice L. Miller, Jr.

[57] ABSTRACT

A heat exchanger coil disposed in a furnace chamber or duct to absorb heat from the furnace to increase the temperature of water passing through said coil from a cold water source to a hot water heater or storage tank is disclosed. An additional feature includes a second heat exchanger coil disposed between the cold water source and the furnace heat exchanger within the confines of a building to absorb heat from the ambient surroundings. An insulated coiled storage unit disposed downstream of the furnace heat exchanger to provide a quantity of additional preheated water to the water heater and a spurge tank overheat and overpressure relief unit for the system is also disclosed.

8 Claims, 2 Drawing Figures

ENERGY CONSERVATION SYSTEM FOR HOT WATER HEATERS AND STORAGE TANKS

BACKGROUND OF THE INVENTION

This invention relates generally to systems which utilize thermal energy available in furnace gases to preheat water being supplied to a water heater from a cold water source.

Generally speaking, such systems are known in the prior art. For example, see U.S. Pat. No. 2,166,355 issued to L. J. Higgins et al on July 18, 1939 which employs a coiled water pipe disposed within a furnace flue or duct to circulate water from the top of a water tank to the bottom thereof to raise the temperature of the water in the tank. Another such prior art system is disclosed in U.S. Pat. No. 3,896,992 issued to A. Borovina on July 29, 1975 wherein hot water from a water heater is supplied directly to water faucets through a coiled water pipe disposed within a furnace. Yet another such prior art system is disclosed in U.S. Pat. No. 3,999,709 issued to P. S. Estabrook on Dec. 28, 1976 wherein water is circulated from a water heater through a heat exchanger located in a furnace chimney and back to the tank once again by means of a pump.

One difficulty encountered in such prior art systems is the necessity of using a pump to force the circulation of water through the heat exchanger.

Another difficulty encountered is the inefficient circulation of water in a closed loop between the hot water heater or storage tank and the furnace heat exchanger.

My invention substantially overcomes these and other prior art problems.

SUMMARY OF THE INVENTION

Briefly, in accordance with the objects of my invention, I provide in combination with a furnace for heating a building and a water heater, a coiled water pipe heat exchanger disposed within a furnace chamber or duct for absorbing heat from the furnace to heat water in the heat exchanger. The heat exchanger is connected between a pressurized source of cold water for the building and a cold water inlet to the heater.

These and other objects of my invention will become apparent to those skilled in the art from the following detailed description and attached drawings upon which, by way of example, only the preferred embodiment of my invention is illustrated.

DESCRIPTION OF THE PREFERRED EMBODIMENTS

Figure 1:
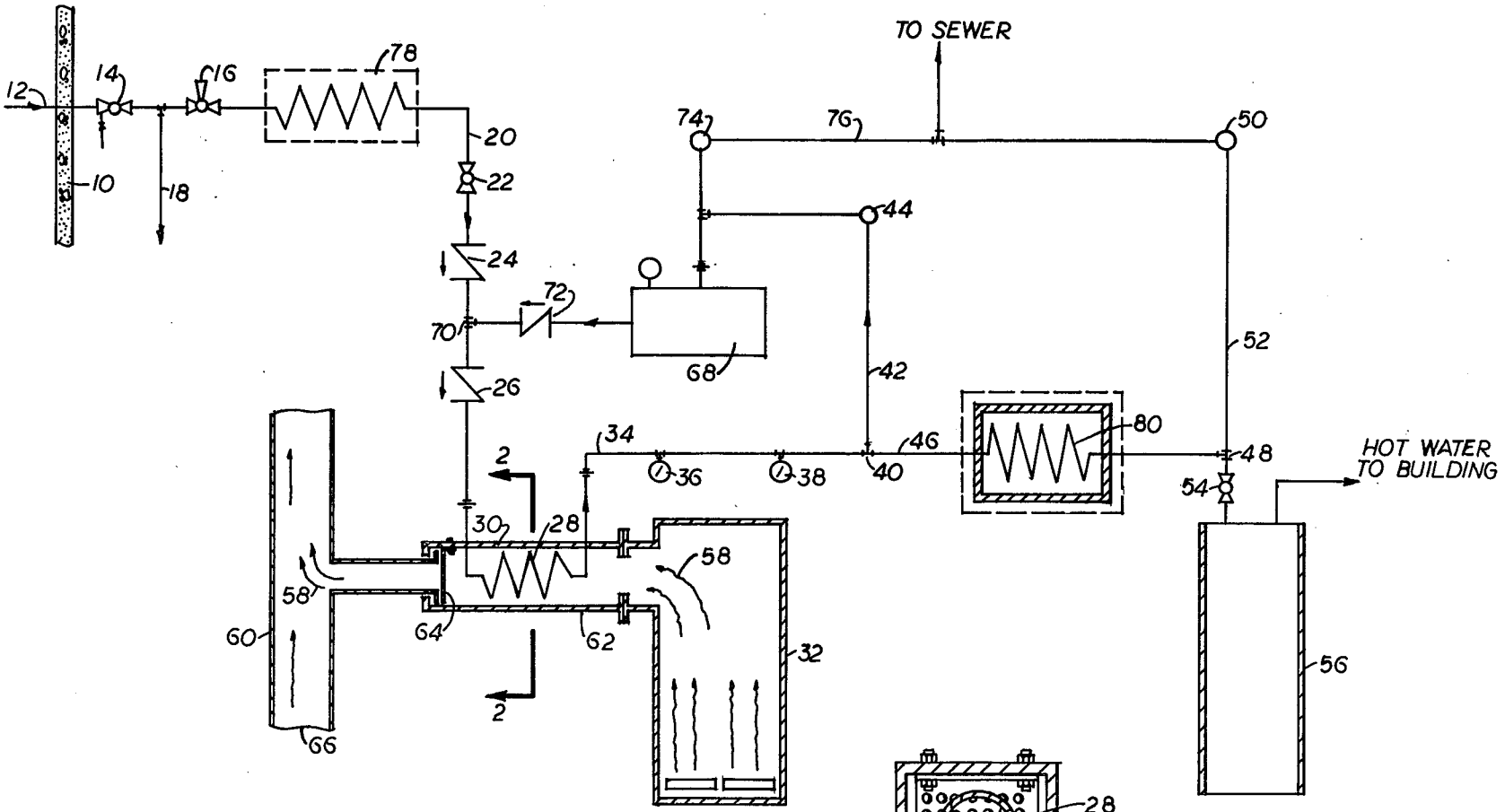
FIG. 1 shows schematically an improved energy conservation system for a hot water heater thus illustrating one preferred embodiment of my invention.

Referring now to the figures, there is shown in one preferred embodiment of my invention an energy conservation system for use in association with a conventional furnace and hot water heater or storage tank.

Water is supplied to a house or other building 10 from a conventional pressurized water source through a water line 12, thence through the usual shut-off valve 14 and, if desired, a pressure regulator 16 set for the maximum demands of the system. Cold water for the requirements of the building 10 is tapped from the source by the water line 18. At this point, water which would normally be supplied to a hot water heater is directed through a line 20 and a manual shut-off valve 22, thence through a pair of one-way check valves 24 and 26 to a coiled water pipe heat exchanger 28 disposed within an exhaust flue 30 or other chamber containing hot gases generated by a furnace 32. The furnace 32 may be any conventional and well known type wherein the heat exchanger 28 may be disposed so as to absorb heat generated therein.

After passage through the heat exchanger 28, the water thus pre-heated by the furnace flue gases is directed through a water line 34, water pressure and temperature gauges 36 and 38, and to a tee 40. At this point, some of the pre-heated water is directed along a branch line 42 to a normally closed relief valve 44 forming a dead end, while the remainder of the pre-heated water flows through a branch line 46 to a tee 48. A pressure-temperature relief valve 50 located at the end of a branch line 52 is normally closed to thus form a dead end on one side of the tee 48, allowing pre-heated water to flow through the tee 48 and a manual shut-off valve 54 and thence into a conventional water heater 56 through the cold water inlet thereof. The pre-heated water thus supplied to the heater 56 from the heat exchanger 28 requires less heat from the heating element of the heater 56 in order to raise the temperature of water stored therein to the desired level than if cold water were supplied directly to the heater 56 from the cold water source at line 20.

Figure 2:
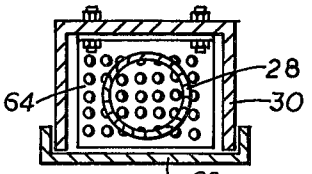
FIG. 2 shows a cross-sectional view of a furnace chimney duct, heat exchanger disposed therein, and condensate drip pan, all as viewed along lines 2—2 of FIG. 1.

The furnace duct 30 which serves to carry hot smoke or other gases 58 to an exhaust chimney 60, may also be provided with a condensate drip pan 62 (See FIG. 2) to collect any condensation that drips from the heat exchanger 28. In order to increase the efficiency of heat absorption of the heat exchanger 28, a baffle 64 may be loosely fitted in the flow path of the flue gases 58 at the downstream side of the duct 30 to cause the flue gases 28 to circulate for a longer time about the exchanger coil 28 before exiting the duct 30 to the chimney 60. The baffle 64 should be sufficiently perforated to allow seepage of the flue gases therethrough to avoid back-filling the furnace system with smoke or exhaust gases. If the baffle 64 is used, I recommend providing a cold air inlet orifice 66 at or near the base of the chimney 60 below the level of the duct 30 to allow the chimney 60 to breathe and thus facilitate the flow of exhaust gases 58 thereto from the duct 30.

As a safety feature of the present example, there is provided a spurge tank 68 connected between the pressure-temperature relief valve 44 and a tee 70 located in the line 20 between the check valves 24 and 26. A one-way check valve 72 is provided in the line between the spurge tank 68 and the tee 70 to restrain cold water flowing from the line 12 to the heat exchanger 28 from backing up into the outlet end of the spurge tank 68. The relief valve 44 is set to open at a first pre-determined maximum temperature and pressure, for example, 125 psi and 200 degrees, such that should either of these conditions occur, the pre-heated water in the line 34 will be diverted to the spurge tank where it may be stored to relieve the overpressure or overheated condition. Recirculation of the overheated or overpressure water in the spurge tank 68 back to the heat exchanger 28 through check valve 72 permits utilization of this pre-heated water until and unless the temperature and/or pressure in the line 34 reaches a a second predetermined level higher than the first (150 psi and/or 210 degrees, for example) at which second level the valve 74 operates to dump the water flowing in the line 34 to a sewer line 76 to be carried away from the building 10.

An additional, optional feature of my invention which can be employed to advantageously increase the efficiency of the system includes a second water pipe coil or heat exchanger 78 which may be disposed in the line 20 downstream of the building cold water supply line 18 within the confines of the building 10 so as to absorb heat from the ambient air therein. The exchanger 78 then functions as a first water pre-heat unit to raise the temperature of the water being supplied to the second stage pre-heat unit, the furnace heat exchanger 28.

A third additional feature of my invention which may be optionally employed is an insulated storage coil 80 inserted in the line 46 between tees 40 and 48. The coil 80 thus serves as a secondary storage facility for a quantity of pre-heated water previously passed through the second pre-heat unit 28 and the first pre-heat unit 78, where used, to thus make a greater quantity of pre-heated water available to the heater 56 during periods of high hot water usage. The coil 80 should preferably be insulated to retain high temperature of the pre-heated water stored therein. The coil 80 is used instead of a simple additional hot water storage tank ahead of the heater 56 so that the water pressure of the system will force the pre-heated water into the heater 56 when called for, without the necessity of providing forced pumping. I recommend the use of heat shrinkable teflon tubing for construction of the coil 80. The spurge tank 68 should be made of non-corrosive metal such as stainless steel since it may contain overhead water at high temperatures.

While the water lines used in most residential houses are 3/4 inch I.D., it is preferable to employ adapter fittings with the heat exchangers 28, 78 and 80 of the present example so that the coils forming these heat exchangers can employ enlarged diameters, specially 1½ inch I.D. This permits the heat exchangers to store an increased volume of pre-heated water to supply the demands of the water heater 56.

Although the subject invention has been described with respect to specific details of certain preferred embodiments thereof, it is not intended that such details limit the scope and coverage of my invention except insofar as is set forth in the following claims.

I claim:

1. In combination with a furnace for heating a building and a water heater, an energy conservation system comprising a first coil of water pipe disposed within a chamber or duct of said furnace for absorbing heat from said furnace to heat water in said first coil, said pipe being connected between a pressurized source of cold water for said building and a cold water inlet of said heater, said system further comprising a spurge tank for storing a quantity of water therein selectively connectable across said first coil, means for diverting water flowing between said first coil and heater inlet to said spurge tank when the pressure of the water flowing between said first coil and heater increases to a first pre-selected maximum pressure value, means for diverting water flowing between said first coil and heater inlet to said spurge tank when the temperature of the water flowing between said first coil and heater inlet increases to a first pre-selected maximum temperature value, first check valve means for restraining the back-filling of said spurge tank with water flowing from said source and from the upstream end of said first coil, second check valve means for restraining the back flow of water to said source from said spurge tank and said first coil, means for venting water and steam from said spurge tank to a sewer line when the pressure of water in said spurge tank reaches a second pre-selected pressure valve, and means for venting water and steam from said spurge tank when the temperature of water in said spurge tank reaches a second pre-selected temperature value.

2. The system of claim 1 further comprising safety means for limiting the temperature of water flowing between said first coil and water heater to a first pre-selected maximum value.

3. The system of claim 1 further comprising safety means for limiting the pressure of water flowing between said first coil and water heater to a first pre-selected maximum value.

4. The system of claim 1 further comprising a second coil of water pipe connected between said source and said first coil and disposed within said building for pre-heating water flowing therethrough from said source to said first coil by absorbing heat from the ambient surroundings within said building.

5. The system of claim 1 further comprising a third coil of water pipe connected between a downstream end of said first coil and said heater inlet, for storing a quantity of preheated water therein when said water heater is full of water.

6. The system of claim 1 further comprising check valve means for restraining water from flowing from said first coil back to said source.

7. The system of claim 1 further comprising a baffle means disposed in said chamber or duct for increasing the circulation of furnace flue gases about said first coil.

8. The system of claim 7 further comprising a chimney connected to said chamber or duct for venting furnace exhaust products from said furnace and building, said chimney defining a cold air inlet orifice therein below the level of said chamber or duct to permit said chimney to breathe and to facilitate the flow of exhaust gases thereto from said chamber or duct.

* * * * *